US007248098B1

(12) United States Patent
Teo

(10) Patent No.: US 7,248,098 B1
(45) Date of Patent: Jul. 24, 2007

(54) CURVATURE CORRECTED BANDGAP CIRCUIT

(75) Inventor: Siew Siong Teo, Sunnyvale, CA (US)

(73) Assignee: National Semiconductor Corporation, Santa Clara, CA (US)

( * ) Notice: Subject to any disclaimer, the term of this patent is extended or adjusted under 35 U.S.C. 154(b) by 512 days.

(21) Appl. No.: 10/808,635

(22) Filed: Mar. 24, 2004

(51) Int. Cl.
*G05F 1/575* (2006.01)
*G05F 1/567* (2006.01)

(52) U.S. Cl. ..... 327/539; 323/314

(58) Field of Classification Search ..... None
See application file for complete search history.

(56) References Cited

U.S. PATENT DOCUMENTS 4,939,442 A * 7/1990 Carvajal et al. ..... 323/281
5,767,664 A * 6/1998 Price ..... 323/313
6,075,354 A 6/2000 Smith et al. ..... 323/313
6,183,131 B1 2/2001 Holloway et al. ..... 374/172
6,232,828 B1 5/2001 Smith et al. ..... 327/539
6,724,176 B1 * 4/2004 Wong et al. ..... 323/316
7,012,416 B2 * 3/2006 Marinca ..... 323/316
7,023,194 B1 * 4/2006 Sutardja et al. ..... 323/314

OTHER PUBLICATIONS

Randall L. Geiger et al., "VLSI Design Techniques for Analog and Digital Circuits," 1990 (p. 369).
Phillip E. Allen et al., "CMOS Analog Circuit Design," 1987 (pp. 591 and 595).

* cited by examiner

*Primary Examiner*—Kenneth B. Wells
*Assistant Examiner*—Terry L. Englund
(74) *Attorney, Agent, or Firm*—Brett A. Hertzberg; Merchant & Gould PC

(57) ABSTRACT

An apparatus and method provide for curvature corrected temperature variations in a band-gap reference circuit. The apparatus includes a band-gap cell, an IPTAT circuit, a resistor, and a feedback circuit. The band-gap cell is arranged to provide a band-gap voltage. The resistor circuit is coupled to both the band-gap cell and the IPTAT circuit. The feedback circuit is arranged to selectively activate the IPTAT circuit such that an additional correction factor is added to the temperature response of the band-gap cell to provide a second order curve. The IPTAT circuit can be implemented as a simple transistor that is responsive to changes in absolute temperature.

18 Claims, 6 Drawing Sheets

CURVATURE CORRECTED BANDGAP CIRCUIT

FIELD OF THE INVENTION

The present invention relates to voltage reference circuits that are temperature compensated. More particularly, the present invention relates to a method and apparatus for compensating the curvature effects in a band-gap reference circuit.

BACKGROUND OF THE INVENTION

Band-gap voltage references are used as voltage references in electronic systems. The energy band-gap of Silicon is on the order of 1.2 V, and is independent from temperature and power-supply variations. Bipolar transistors have a negative temperature drift with respect to their base-emitter voltage (Vbe) such that their Vbe decreases as the operating temperature increases on the order of −2 mV/deg C. However, the thermal voltage (Vt) of a bipolar transistor has a positive temperature drift (Vt=kT/q) such that Vt increases as temperature increases. The positive temperature drift in the thermal voltage (Vt) may be arranged to compensate the negative temperature drift in the bipolar transistor's base-emitter voltage (Vbe). Band-gap reference circuits use the inherent characteristics of bipolar transistors to compensate for temperature effects and provide a stable operating voltage over various power-supply and temperature ranges.

An example of a modern band-gap reference circuit is illustrated as circuit 500 in FIG. 5. As shown in the figure, two bipolar transistors (Q1, Q2) are arranged with a common base that is connected to VDD. Two resistors (R1, R2) are series connected between the emitter of the first bipolar transistor (Q1) and the reference output (VREF). Another resistor (R3) is connected between the emitter of the second bipolar transistor (Q2) and the reference output (VREF). An error amplifier (EAMP) is used to adjust the voltage of the reference output (VREF) through feedback. At steady-state, the voltage at the common point of resistors R1 and R2 is the same as the voltage at the emitter of the second bipolar transistor (Q2). The two bipolar transistors (Q1, Q2) are arranged to provide a ten-to-one (10:1) current density difference with respect to one another (Q2 to Q1). The ten-to-one current density results in a 60 mV difference between the base-emitter voltages of two bipolar transistors ($\Delta Vbe=Vt*\ln(A1/A2)=26\ mV*\ln(10)=60\ mV$, at room temperature. A1 and A2 are the respective emitter areas of bipolar transistors Q1 and Q2. Current I1 is set to equal current I2 by means of resistors R2, R3, and feedback operation of error amplifier EAMP. The 60 mV difference appears across the first resistor (R1). The voltage between VDD and the output of the error amplifier corresponds to a reference voltage (VREF) that is given as $VREF=Vbe+X*Vt$, where X is a constant that is used to scale the temperature correction factor. The temperature correction factor (X) is adjusted by the ratio of the resistors ($(R2/R1)*\ln(A1/A2)$). Typical temperature corrected reference voltages of 1.25 V are achieved by his configuration.

BRIEF DESCRIPTION OF THE DRAWINGS

Non-limiting and non-exhaustive embodiments of the present invention are described with reference to the following drawings.

DETAILED DESCRIPTION OF THE PREFERRED EMBODIMENT

Figure 1:
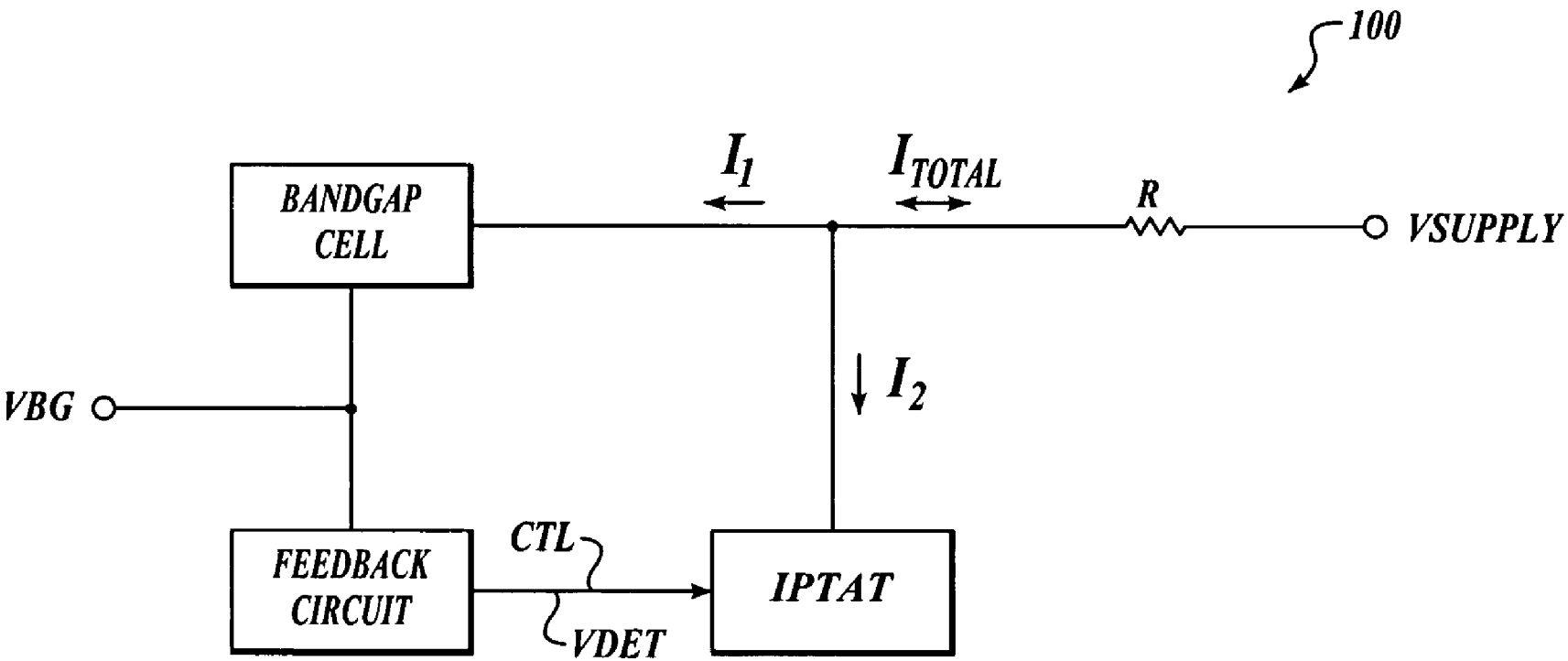
FIG. 1 is an illustration of an example curvature corrected band-gap circuit.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Throughout the specification and claims, the following terms take at least the meanings explicitly associated herein, unless the context clearly dictates otherwise. The meanings identified below are not intended to limit the terms, but merely provide illustrative examples for the terms. The meaning of "a," "an," and "the" includes plural reference, the meaning of "in" includes "in" and "on." The term "connected" means a direct electrical connection between the items connected, without any intermediate devices. The term "coupled" means either a direct electrical connection between the items connected or an indirect connection through one or more passive or active intermediary devices. The term "circuit" means either a single component or a multiplicity of components, either active and/or passive, that are coupled together to provide a desired function. The term "signal" means at least one current, voltage, charge, temperature, data, or other signal.

Briefly stated, the invention is related to an apparatus and method for providing curvature correction to the temperature variations in a band-gap reference circuit. The apparatus includes a band-gap cell, an IPTAT circuit, a resistor, and a feedback circuit. The band-gap cell is arranged to provide a band-gap voltage. The resistor circuit is coupled to both the band-gap cell and the IPTAT circuit. The feedback circuit is arranged to selectively activate the IPTAT circuit such that an additional correction factor is added to the temperature response of the band-gap cell to provide a second order curve. The IPTAT circuit can be implemented as a simple transistor that is responsive to changes in absolute temperature. The second-order temperature corrected curves have improved operating temperature ranges with minimal voltage variations when compared to a conventional band-gap circuit.

Typical CMOS band-gap circuits have output voltages that are temperature independent only to a first order. At some critical temperature, the band-gap voltage corresponds to a maximum value. However, at temperatures above and below the critical temperature the band-gap circuit exhibits second order effects that result in non-linear changes in the band-gap voltage. The non-linear effects are observable as a curvature in the temperature response of the band-gap voltage. The present invention provides a simple method to correct the output voltage curvature effect as will be described below.

FIG. 1 is an illustration of an example curvature corrected band-gap circuit (100) that is arranged in accordance with an aspect of the present invention. Circuit 100 includes a band-gap cell, a feedback circuit, an IPTAT (current proportional to absolute temperature) circuit, and a resistor circuit. The band-gap cell is arranged to provide a band-gap voltage (VBG), and operates with a current (I1). The feedback circuit is arranged to sense the band-gap voltage (VBG) and provide a detection signal (VDET). The IPTAT circuit is activated in response to the detection signal (VDET) and is arranged to provide another current (I2). Resistor R is coupled between the band-gap cell and a power supply voltage (VSUPPLY). A total current (ITOTAL) flows through resistor R that is related to currents I1 and I2. The band-gap voltage (VBG) is related to the total current flowing through resistor R as will be described in further detail below.

Figure 2:
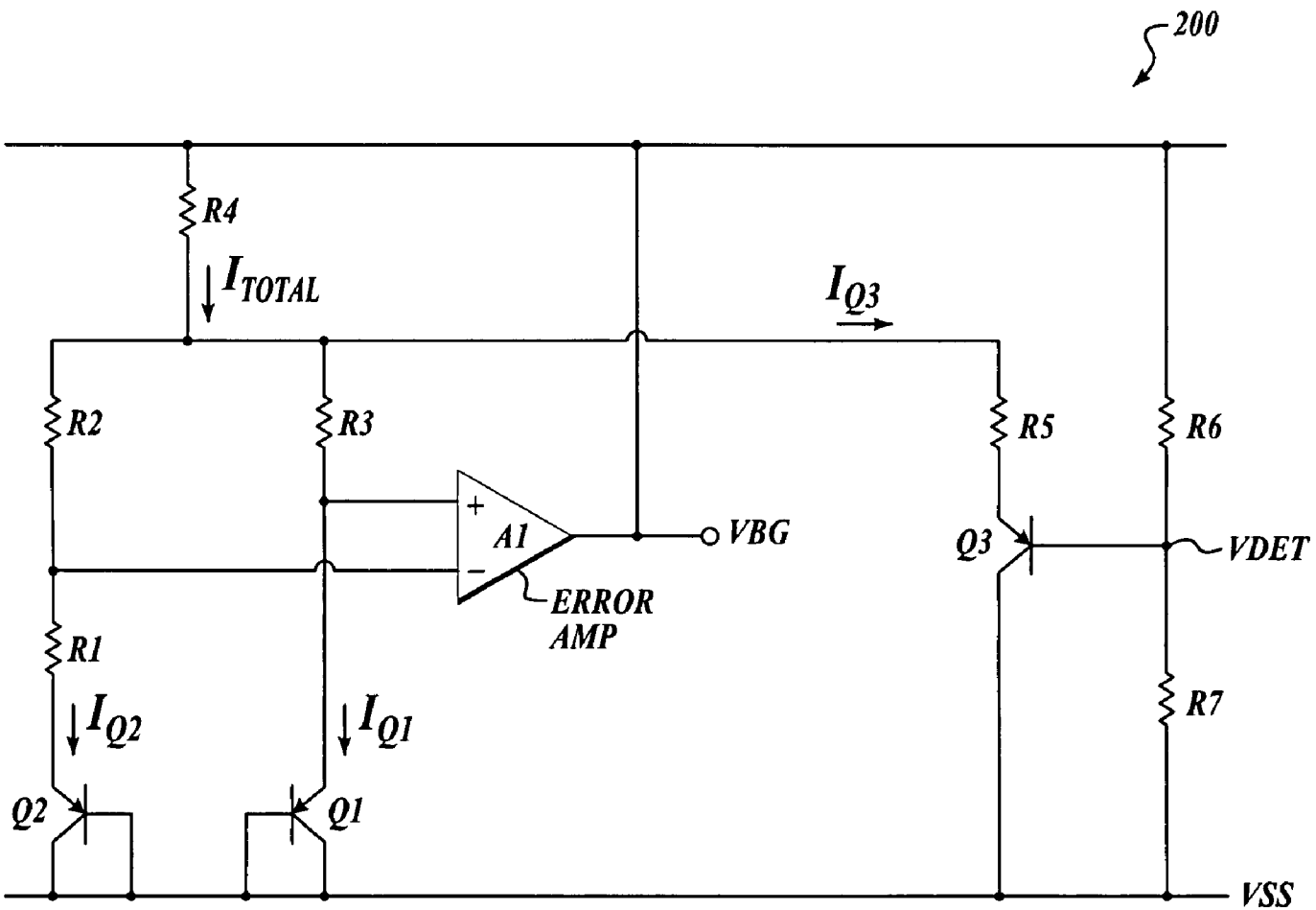
FIG. 2 is an illustration of another example curvature corrected band-gap circuit.

FIG. 2 is an illustration of another example curvature corrected band-gap circuit (200) that is arranged in accordance with aspects of the present invention. Circuit 200 is substantially the same in operation as circuit 100, with further detailed functional blocks as will be described.

In circuit 200, the band-gap cell is illustrated as transistors Q1 and Q2, resistors R1-R3, and error amplifier A1; resistor R is illustrated as resistor R4; the feedback circuit is illustrated as resistors R6 and R7; and the IPTAT circuit is illustrated as resistor R5 and transistor Q3. The supply voltage corresponds to VSS for this example circuit.

Transistor Q1 is a diode connected PNP device that has an emitter that is coupled to the non-inverting input of error amplifier A1. Transistor Q2 is another diode connected PNP device that has an emitter that is coupled to the inverting input of error amplifier A1 through resistor R1. Resistor R2 is coupled between resistor R4 and the inverting input of amplifier A1, while resistor R3 is coupled between resistor R4 and the non-inverting input of error amplifier A1. Resistor R4 is also coupled to the output of error amplifier A1, which corresponds to the band-gap voltage of the circuit. Resistors R6 and R7 are arranged as a voltage divider that senses the band-gap voltage and provide a detection voltage (VDET). Transistor Q3 is a PNP transistor that has a collector that is coupled to the power supply voltage (VSS), an emitter that is coupled to resistor R4 through resistor R5, and a base that is responsive to the detection voltage (VDET).

In operation, transistor Q1 is arranged to conduct a first current that is designated as IQ1, and transistor Q2 is arranged to conduct a second current that is designated as IQ2. Since the band-gap voltage (VBG) is regulated through the feedback operation of error amplifier A1, the detection voltage (VDET) remains relatively unchanged over varied operating temperatures. The base-emitter voltage (VBE) of transistor Q3 is dependent on the absolute temperature of the circuit such that VBEQ3 decreases with increasing temperature. Consequently, transistor Q3 will remain inactive until the VBE decreases sufficient to forward bias transistor Q3. The detection voltage (VDET) is selected to adjust the temperature trip point for activating transistor Q3. Transistor Q3 is arranged to conduct a third current (IQ3), designated IQ3, when activated.

The band-gap cell is arranged such that currents IQ1 and IQ2 remain balanced according to the relative areas associated with transistors Q1 and Q2. In many band-gap cells, the ratio of the areas for transistors Q2 and Q1 corresponds to 10:1. For lower temperature, transistor Q3 is inactive and IQ3 is approximately zero. As the temperature increases, transistor Q3 will approach a temperature trip-point where it becomes forward biased. Once forward biased, the current through transistor Q3 will increase with increased temperature. Currents IQ1-IQ3 are summed together through resistor R4 such that the band-gap voltage will increase once the temperature trip-point is reached for transistor Q3.

Figure 3:
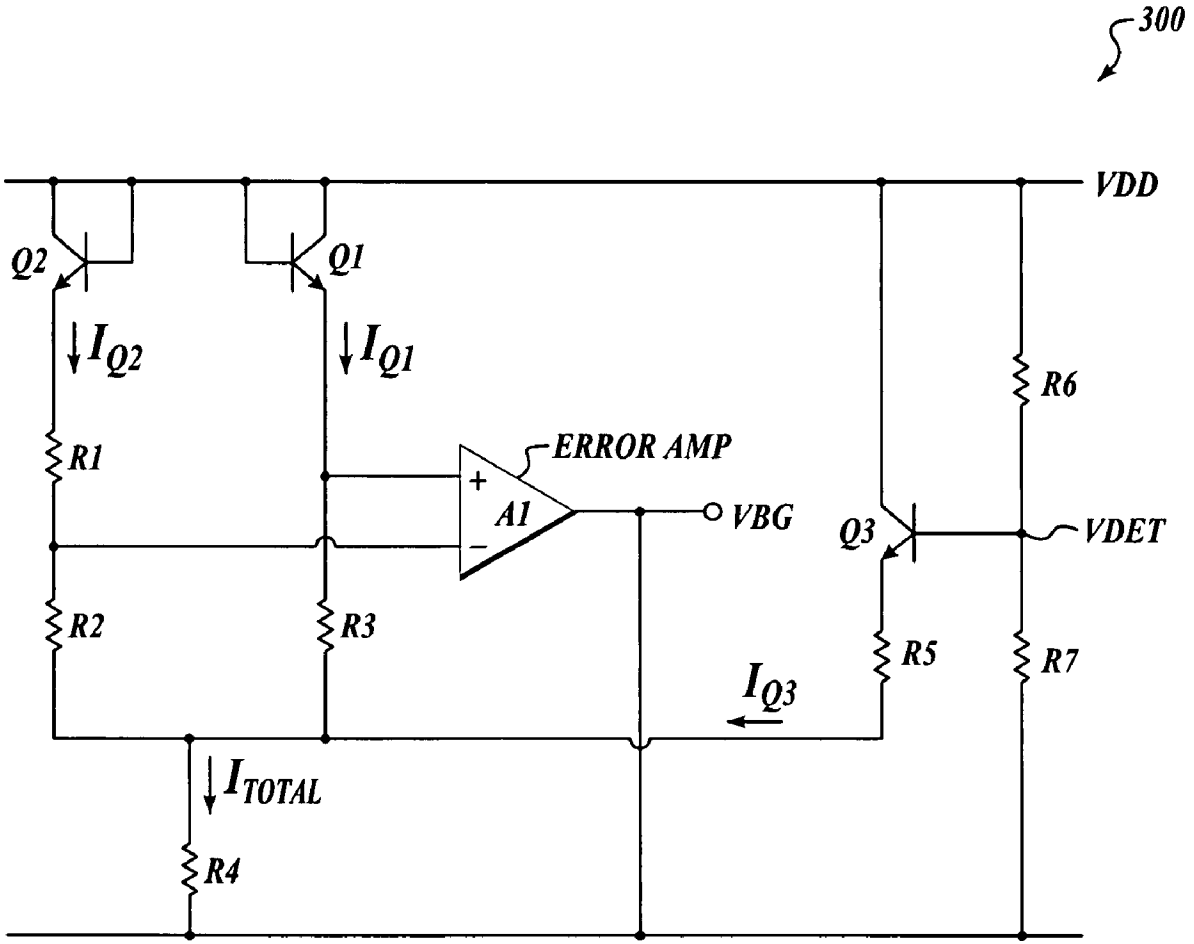
FIG. 3 is an illustration of yet another example curvature corrected band-gap circuit.

FIG. 3 is an illustration of yet another example curvature corrected band-gap circuit (300) that is arranged in accordance with aspects of the present invention. Circuit 300 is substantially the same in operation as circuit 100, with further detailed functional blocks as will be described.

In circuit 300, the band-gap cell is illustrated as transistors Q1 and Q2, resistors R1-R3, and error amplifier A1; resistor R is illustrated as resistor R4; the feedback circuit is illustrated as resistors R6 and R7; and the IPTAT circuit is illustrated as resistor R5 and transistor Q3. The supply voltage corresponds to VDD for this example circuit.

Transistor Q1 is a diode connected NPN device that has an emitter that is coupled to the non-inverting input of error amplifier A1. Transistor Q2 is another diode connected NPN device that has an emitter that is coupled to the inverting input of error amplifier A1 through resistor R1. Resistor R2 is coupled between resistor R4 and the inverting input of amplifier A1, while resistor R3 is coupled between resistor R4 and the non-inverting input of error amplifier A1. Resistor R4 is also coupled to the output of error amplifier A1, which corresponds to the band-gap voltage of the circuit. Resistors R6 and R7 are arranged as a voltage divider that senses the band-gap voltage and provide a detection voltage (VDET). Transistor Q3 is an NPN transistor that has a collector that is coupled to the power supply voltage (VDD), an emitter that is coupled to resistor R4 through resistor R5, and a base that is responsive to the detection voltage (VDET). The operation of circuit 300 is substantially similar to the operation of circuit 200, where the band-gap voltage is referenced from VDD instead of VSS.

Figure 4:
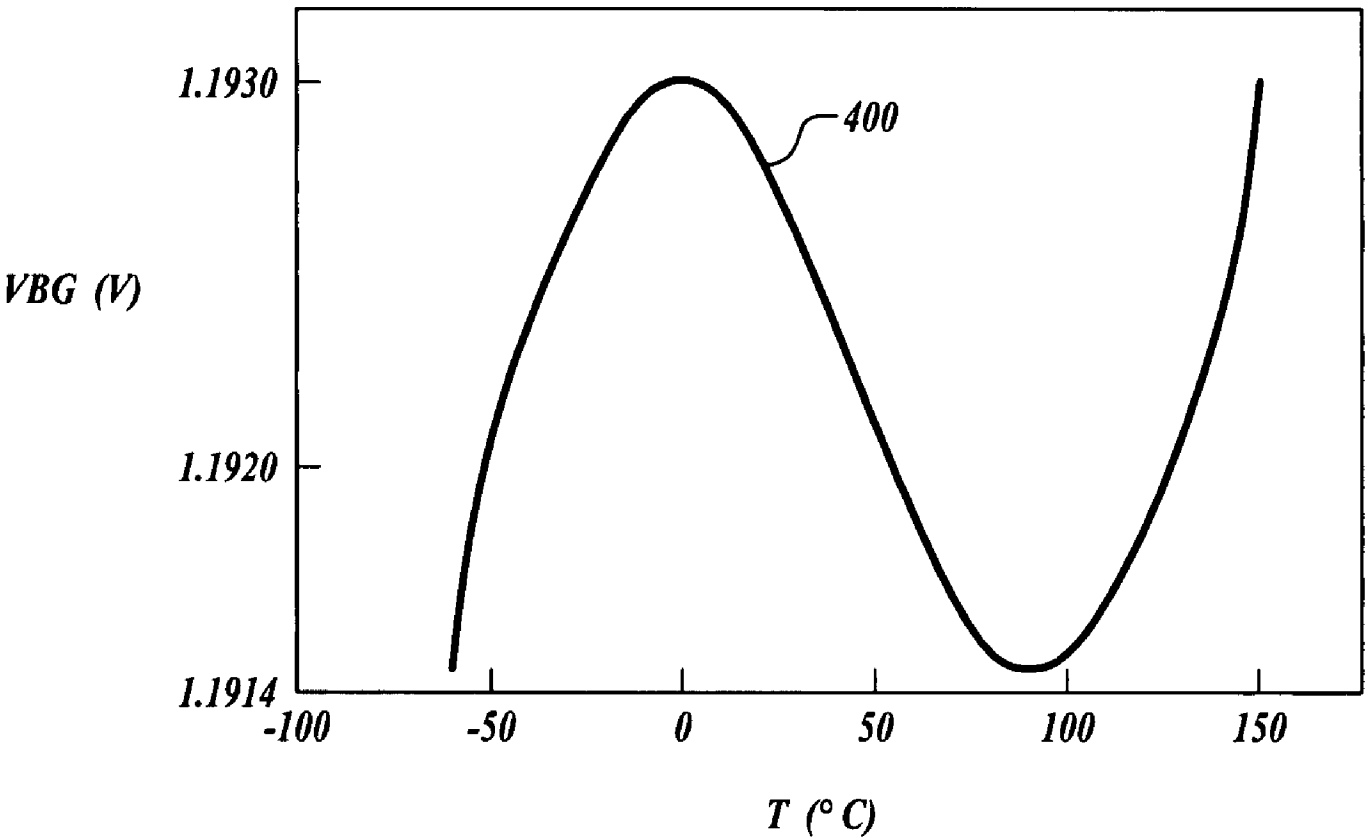
FIG. 4 is an example waveform for a curvature corrected band-gap circuit, arranged in accordance with an aspect of the present invention.

FIG. 4 is an example waveform for a curvature corrected band-gap circuit, arranged in accordance with an aspect of the present invention. In a first operating temperature range (e.g., −50° C. through +50° C.), the band-gap voltage (VBG) has a temperature corrected shape (400) that is similar to a typical band-gap circuit. In a second operating temperature range (e.g., +50° C. through +150° C.), the bang-gap voltage (VBG) temperature response changes direction and begins increasing with increasing temperature. The overall temperature response of the band-gap circuit is improved since the operating temperature range is extended with minimal voltage variations when compared to a conventional band-gap circuit. FIG. 4 illustrates how the IPTAT circuit cooperates with the band-gap cell to provide an extended operating temperature range.

Figure 5:
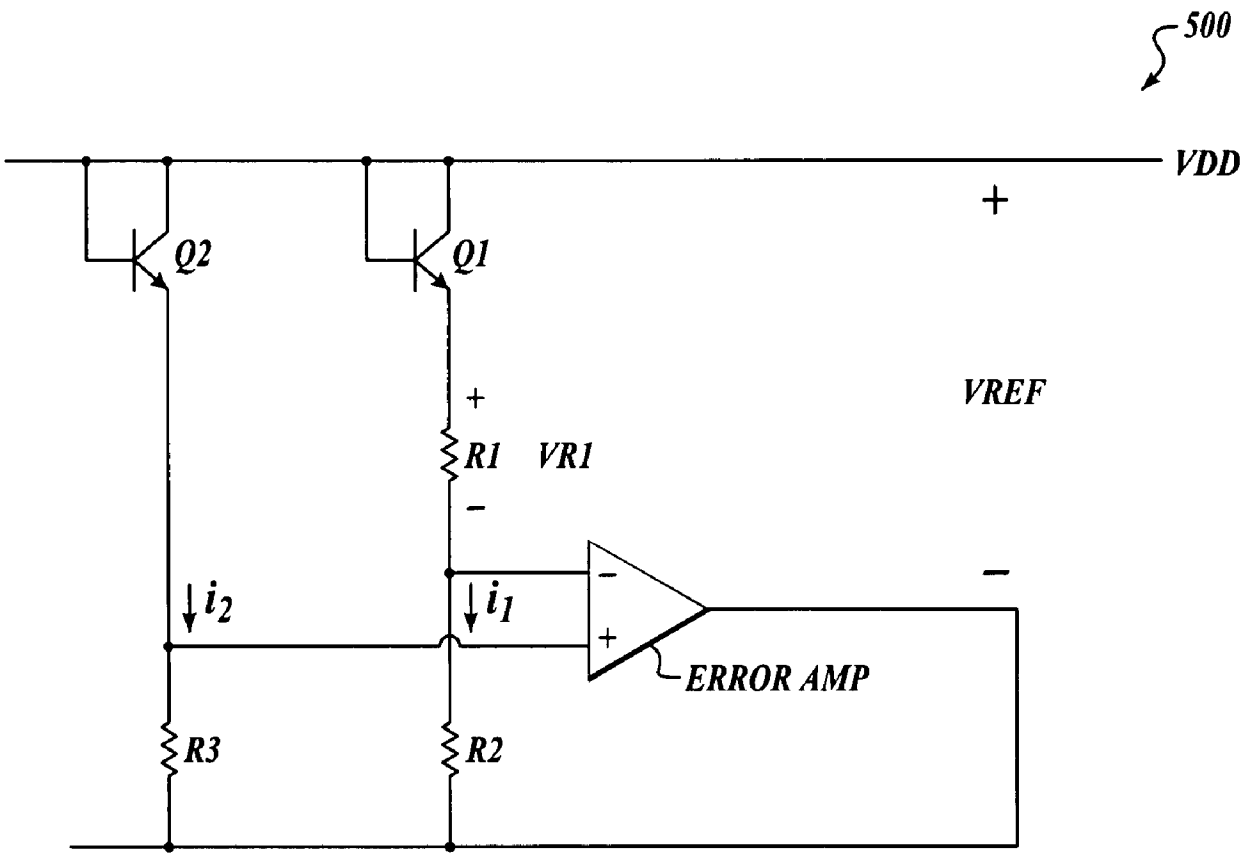
(PRIOR ART) FIGURE 5
FIG. 5 is an illustration of a conventional band-gap circuit.
Figure 6:
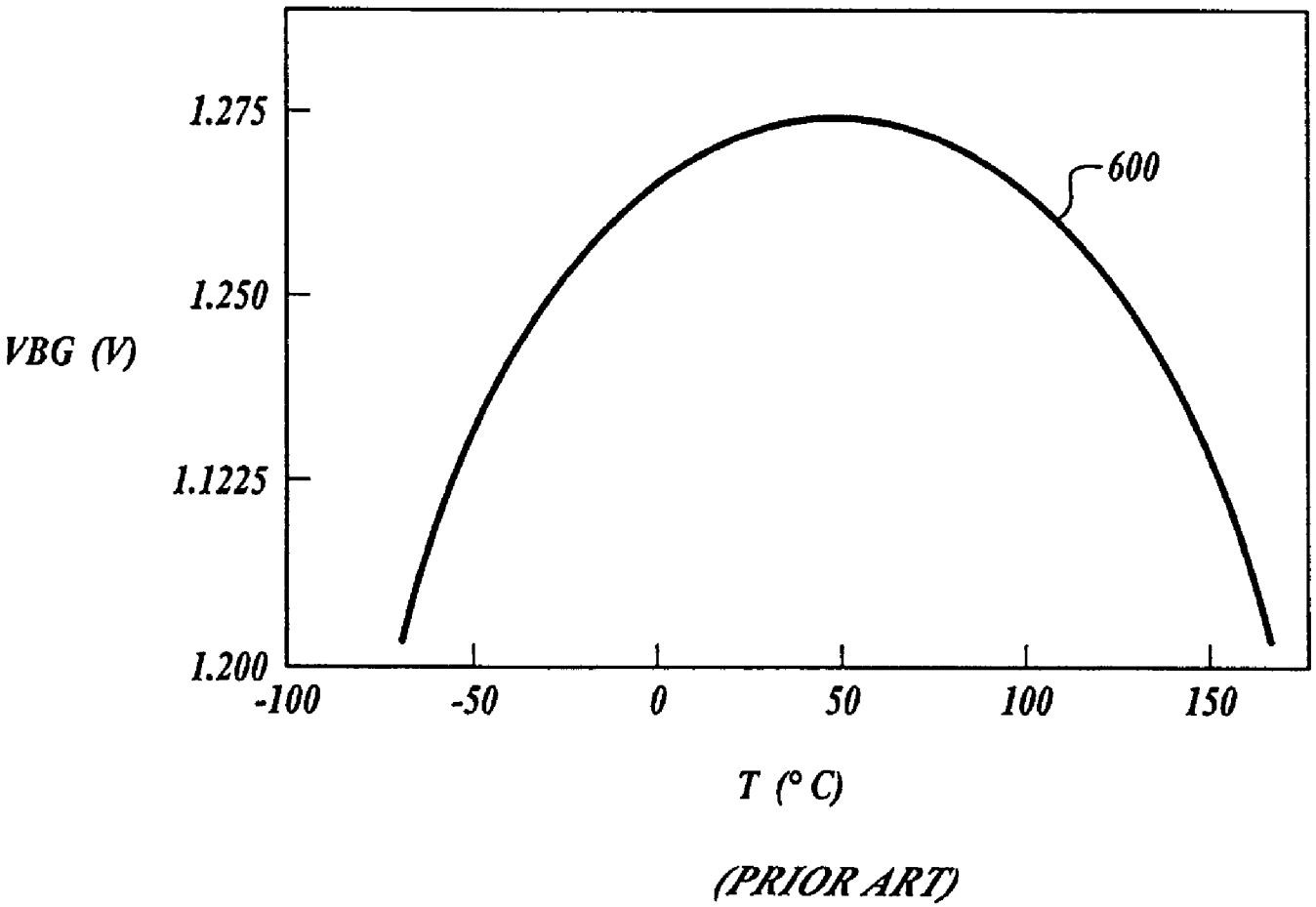
(PRIOR ART) FIGURE 6
FIG. 6 is an example waveform for a conventional band-gap circuit.

FIG. 5 is an illustration of a conventional band-gap circuit. The balanced current operation in the conventional band-gap circuit provides for a temperature compensated band-gap voltage (VBG) as illustrated in FIG. 6. The temperature compensated voltage has a curvature (600) that is concave (or convex) in shape such that the voltage variations are compensated over an operating temperature range. The curvature is intentionally designed with a single maxima point that is approximately centered over the operating temperature range. In contrast, the present invention has a maxima point and a minima point such that second order temperature effects are observed. In the present invention, the second order effects are intentionally provided to minimize the voltage variations over a wide operating temperature range.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. An apparatus for providing a temperature compensated reference signal, comprising:

a band-gap cell that is arranged to provide a first signal that has a first temperature response profile, wherein the band-gap cell comprises a first bipolar device, a second bipolar device, a first resistor that is coupled between a first sense node and the first bipolar device, a second resistor that is coupled between the first sense node and a common node, a third resistor that is coupled between the common node and the second bipolar device at a second sense node, and an error amplifier that is responsive to signals from the first sense node and the second sense node, wherein a resistor circuit is coupled between an output node of the error amplifier and the common node;

a PTAT circuit that is arranged to selectively provide a second signal that has a second temperature response profile to the common node when active;

a feedback circuit that is arranged to selectively activate the PTAT circuit in response to an output from the band-gap cell, wherein the output of the band-gap cell corresponds to the output node of the error amplifier; and the resistor circuit, that is coupled between the output from the band-gap cell and the common node, is arranged in cooperation with the band-gap cell and the PTAT circuit to generate the temperature compensated reference signal at the common node as a combination of the first signal and the second signal such that the temperature compensated reference signal has a third temperature response profile that is determined by combination of the first temperature response profile and the second temperature response profile.

2. The apparatus of claim 1, wherein the first temperature response profile is different from the second temperature response profile.

3. The apparatus of claim 1 wherein the first signal and the second signal are currents, and wherein the resistor circuit is arranged to combine the currents that are associated with the first and second signals.

4. The apparatus of claim 1, wherein the first bipolar device and the second bipolar device are ratio scaled with respect to one another.

5. The apparatus of claim 1, wherein the feedback circuit comprises at least one of: a passive feedback circuit, an active feedback circuit, a voltage divider circuit, a gain scaling circuit, a resistor divider circuit, a capacitive divider circuit, and a stacked diode circuit.

6. The apparatus of claim 1, wherein the feedback circuit corresponds to a voltage divider circuit that senses the output of the band-gap cell.

7. The apparatus of claim 1, wherein the PTAT circuit comprises at least one of: a voltage reference circuit that is configured to provide the second signal as a voltage, and a current reference circuit that is configured to provide the second signal as a current.

8. The apparatus of claim 1, wherein the PTAT circuit includes a bipolar junction device that is arranged to provide the second signal as a current that is proportional to absolute temperature.

9. The apparatus of claim 1, wherein the PTAT circuit includes a bipolar junction device that is arranged to provide the second signal as a voltage that is proportional to absolute temperature.

10. The apparatus of claim 1, wherein the PTAT circuit is arranged to activate when an operating temperature associated with the apparatus reaches a temperature trip point.

11. The apparatus of claim 1, wherein the band-gap cell is referenced from at least one of: a high supply signal, a low supply signal, and a ground reference signal.

12. The apparatus of claim 1, wherein the temperature compensated reference signal corresponds to at least one of a current and a voltage.

13. An apparatus for providing a temperature compensated reference signal, comprising:

a band-gap cell means that is coupled between a first common node and a power supply node, wherein the band-gap cell means is arranged to provide a first signal that has a first temperature response profile at the first common node, wherein the band-gap cell means is also arranged to provide an output at a second common node;

a PTAT means that is arranged to selectively provide a second signal that has a second temperature response profile at the first common node when active, wherein the second temperature response profile is proportional to absolute temperature;

a sense means that is arranged to sense the output of the band-gap cell means at the second common node and selectively activate the PTAT means in response to the sensed output; and a resistor means that is coupled between the second common node and the first common node, wherein the resistor means is arranged to combine the first signal and the second signal at the first common node such that the output of the band-gap cell means at the second common node corresponds to a temperature compensated reference signal with a third temperature response profile that is determined by combination of the first temperature response profile and the second temperature response profile.

14. The apparatus of claim 13, wherein the PTAT means comprises at least one of: a voltage reference means that is configured to provide the second signal as a voltage, and a current reference means that is configured to provide the second signal as a current.

15. The apparatus of claim 13, wherein the band-gap cell means is referenced at the power supply node from at least one of: a high supply signal, a low supply signal, and a ground reference signal.

16. The apparatus of claim 13, wherein the temperature compensated reference signal corresponds to at least one of a current and a voltage.

17. A method for providing a temperature compensated reference signal, comprising:

coupling a band-gap cell between a first common node and a power supply node;

coupling a resistor between the first common node and a second common node;

providing a band-gap voltage from the band-gap cell at the second common node when the band-gap cell is active, wherein the band-gap cell is arranged to operate with a first temperature profile;

monitoring voltages at the second common node with a voltage divider to provide a feedback signal that is responsive to changes in the band-gap voltage;

coupling the feedback signal to an input of a PTAT circuit that has a second temperature profile;

activating the PTAT circuit in response to the feedback signal when an operating temperature associated with the PTAT circuit reaches a temperature trip-point; and coupling an output signal from the PTAT circuit to the first common node when the PTAT circuit is active such that the temperature profile associated with the band-gap voltage is modified by the PTAT circuit to create a third temperature profile that corresponds to the combined temperature profiles of the band-gap cell and the PTAT circuit.

18. The method of claim 17, wherein the first temperature profile corresponds to a band-gap curve, the second temperature profile corresponds to a proportional to absolute temperature curve, and the third temperature profile corresponds to a curvature corrected band-gap curve.

* * * * *